United States Patent [19]

Walling et al.

[11] Patent Number: 4,518,633

[45] Date of Patent: May 21, 1985

[54] PRODUCTION OF INSULATED ELECTRICAL CONDUCTORS

[75] Inventors: Jorg-Hein Walling, Beaconsfield; Michael A. Shannon, Glenburnie; Gerald Arbuthnot, Chateauquay, all of Canada

[73] Assignee: Northern Telecom Limited, Montreal, Canada

[21] Appl. No.: 597,381

[22] Filed: Apr. 6, 1984

[51] Int. Cl.[3] ..... B05D 5/12

[52] U.S. Cl. ..... 427/120; 427/117; 427/128; 427/130; 427/358; 427/385.5; 427/434.7; 427/435; 118/125; 118/405; 118/DIG. 18

[58] Field of Search ..... 427/117, 120, 128, 130, 427/358, 385.5, 434.7, 435; 118/125, 405, DIG. 18

[56] References Cited

U.S. PATENT DOCUMENTS 4,079,192 3/1978 Josse ..... 174/126 CP 4,130,676 12/1978 Ichiyanagi et al. ..... 427/117

*Primary Examiner*—Richard Bueker

*Attorney, Agent, or Firm*—R. J. Austin

[57] ABSTRACT

In a method of insulating an electrical conductor, the conductor passes upwardly through a coating fluid and a die means which is carried in a vertical position by a supporting fluid force. This force is provided by the supporting force of the fluid or a magnetic force which holds the die in suspension. Freedom for horizontal movement of the die is provided to enable it to move in a manner corresponding to any lateral movement of the conductor, this die movement being controlled by hydrodynamic forces between conductor and die to maintain the concentricity of a fluid layer formed on the conductor.

18 Claims, 10 Drawing Figures

PRODUCTION OF INSULATED ELECTRICAL CONDUCTORS

This invention relates to the production of insulated electrical conductors.

Telecommunications cable comprises a core of insulated electrical conductors arranged in twisted pairs. Each conductor in each pair may have at least one insulation layer comprising polymeric material which should be concentric with the conductor. Loading is applied to voice transmission cable to increase the inductance and decrease the attenuation of a pair of conductors over a band of frequencies. Loading is provided to decrease attenuation in the voice frequency range, i.e. up to about 5 KHz and is also useful to decrease attenuation in the lower carrier frequency ranges.

Conventionally, loading is in a discrete form, i.e. it is applied at spaced intervals along the cable and is typically accomplished by splicing discrete loading coils into the pairs at regular intervals.

An alternative loading which has been suggested is in the form of a continuous layer surrounding each conductor which will be referred to as "continuous loaded layer". This layer is composed of particles of magnetically permeable material dispersed in a dielectric carrier material which may be polymeric, the particles separated from each other to render the layer substantially non-conductive. Surrounding this layer is another layer formed from dielectric material and without use of the magnetically permeable particles. This form of insulated conductor has been described in U.S. Pat. No. 4,079,192, in the name of B. Josse, dated Mar. 14, 1978 and entitled "Conductor For Reducing Leakage at High Frequencies", and also in British Pat. No. 313,895 and German Offenlegungsschrifts Nos. 2,050,913 and 2,461,611.

Problems are associated with the manufacture of conductor having a covering continuous loaded layer. At least some of these problems relate to the fact that the layer is applied as a mixture of fluid dielectric carrier material and particles. To enable homogeneity of the mix, the carrier material is of essentially lower viscosity than dielectric material for conventional insulating layers. More viscous material results in resistance to dispersion of the particles during mixing. As the composite material has a lower viscosity, it has been found that it cannot be applied by conventional extrusion methods for the forming of dielectric layers upon electrical conductors as the material of the layer tends to flow around the conductor under gravity. Thus in the completed layer after hardening, the layer is thicker in some places than others thereby causing eccentricity of the conductor within the layers. This eccentricity leads to non-uniformity in electrical characteristics of the insulated conductor and uncontrollable variations in mutual capacitance between the conductors in the completed cable.

Other problems associated with eccentricity occur during manufacture. If an eccentric continuous loaded layer is provided and a further layer is to be provided, then during movement of the conductor along its path bearing the continuous loaded layer, the eccentricity is apt to cause a peeling action of the loaded layer, because the mechanical strength of the layer is not balanced radially in all directions. This may result in clogging of any guides or even in die parts to be used for applying an outer layer upon the loaded layer.

The present invention provides a method and apparatus for providing an insulating layer upon a conductor wherein the layer, while possibly being formed from a low viscosity material which normally would produce eccentricity problems upon a conductor, does in fact provide an acceptable concentricity.

Accordingly, the present invention provides a method of providing an insulated electrical conductor by passing the conductor upwardly through a coating fluid and then upwardly through a die which is held in a vertical position relative to the fluid by a supporting fluid force, the die controlling the thickness of a surrounding layer of the fluid upon the conductor, and the viscosity of the fluid being insufficient to raise the die out of the fluid as the fluid coated conductor passes up through the die.

The supporting fluid force may be provided by the coating fluid itself with the die floatingly carried by the coating fluid. In this case, the die is free to move horizontally. Hence, the copper conductor which cannot in practice follow a vertical path in an absolutely fixed position, moves the die horizontally as the conductor wanders in any direction laterally of its longitudinal axis. The hydrodynamic forces existing between the conductor and the surfaces of the die provide a consistently balanced distribution of stresses which, in turn, dictate a constant thickness of the fluid layer and its concentricity with the conductor.

Alternatively, the supporting fluid force is provided at least partly by a pressurized gas. As a further alternative, the supporting fluid force is a magnetic flux.

In the above method according to the invention, the fluid is preferably a homogeneous mixture of a fluid carrier and magnetically permeable particles to provide, after drying, a continuous loaded layer.

The use of a magnetic flux as the supporting fluid force is particularly useful when the coating fluid is a mixture of carrier and magnetically permeable particles. The magnetic field which is created tends to orientate the particles either radially or axially of the conductor. This orientation renders the electrical characteristics of the layer more constant along the length of the conductor.

In the method according to the invention, to prevent the fluid from drying in the immediate upstream region from the die orifice, it is preferable that air is prevented from reaching regions directly upstream of the die orifice.

The invention also includes apparatus for insulating an electrical conductor including a container for holding a quantity of a coating fluid, a die means having a die orifice and a supporting fluid force means to hold the die means in a certain vertical position when the coating fluid is in the container and the die orifice is directed upwardly.

In the above apparatus, regions directly upstream from the die orifice and forming an entrance thereto are preferably completely sealed from ambient atmosphere to prevent drying of the coating fluid in these regions or at the die orifice itself.

In one preferred apparatus, the apparatus also includes the coating fluid which comprises at least part of the supporting fluid force means by the die means being floatingly carried by the coating fluid.

In alternative apparatus, the supporting fluid force means comprises confronting surfaces defined between elements, the surfaces defining passage means for pressurized gas defined between the elements, one at least of which is the die means.

In a further alternative apparatus, the supporting fluid force means comprises means for creating a magnetic flux. This may comprise a magnet which forms a part of the die means and the magnet and thus the die means is controlled in position by the flux. As one example of this, the die means provides a permanent magnet and is surrounded by another magnet which may be permanent or connectable to a DC current. With the magnets both having upwardly converging surfaces with the surfaces confronting each other, and with poles of the magnets suitably matched and relatively positioned radially of the die orifice, then the permanent magnet is held upwardly from the surrounding magnet by the magnetic flux. As another example, and which is suitable solely for use with a coating fluid comprising a mixture of a fluid carrier with magnetically permeable particles, the die means comprises a magnet with its poles disposed in the direction of fluid flow through the die orifice. With the die orifice directed upwardly, the magnet is immersed within the fluid and the magnetic flux levitates the magnet and thus the die means to a position in the fluid dependent on the strength of the flux and the quantity and permeability of the particles.

In the above method and apparatus, any fluid having the correct viscosity so as not to provide sufficient upward force to raise the die means and suitable as a coating material will suffice. Such fluids include certain enamel or latex paints and plastics with a sufficiently high temperature to decrease the viscosity to that required. The maximum viscosity which may be effectively used without raising of the die means depends on certain parameters, such as die design, feed speed of the conductor and the thickness of the layer of insulation to be provided. By way of example, a viscosity below 5000 centipoise has been established as being suitable for a 45% solids latex in admixture with 40% solids by weight of the total mixture of ferrite particles.

Embodiments of the invention will now be described, by way of example, with reference to the accompanying drawings in which.

Figure 1:
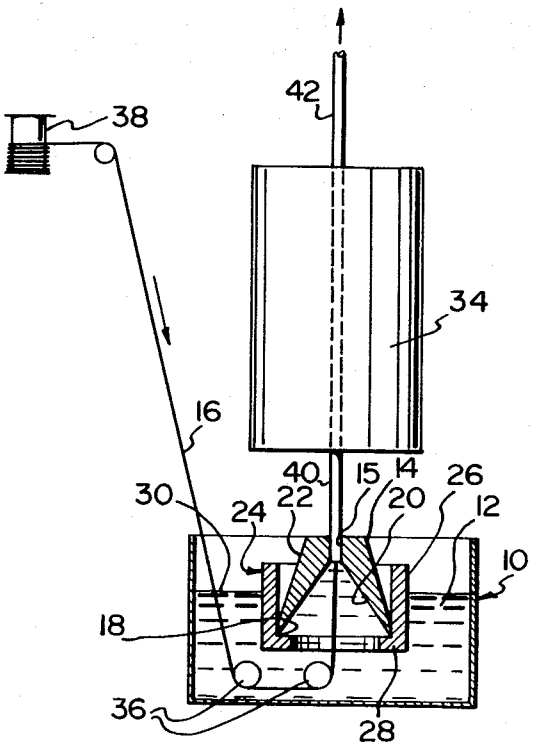
FIG. 1 is a cross-sectional view through apparatus according to a first embodiment for providing an insulating layer upon an electrical conductor.

As shown in FIG. 1, in a first embodiment, apparatus for providing an insulating layer upon an electrical conductor comprises a container 10 holding a certain quantity of a coating fluid. While this fluid may be of any material suitable for use with the apparatus and for forming a layer of insulation, in this particular instance the fluid is a homogeneous mixture 12 of a fluid carrier and magnetically permeable particles in the form of ferrite particles. The fluid carrier may be any carrier which is suitable for the purpose, but in this particular case is a latex solution with a 45% solids content by weight of the total solution and which is cross-linkable to enable the finished coating to be made by a curing process. The solution in this embodiment is specifically an crylic material sold by Rhoplex under their trade No. NE1612.

Freely movably floating within the mixture 12 is a die means comprising a wiping die 14 formed with a die aperture 15 for providing a layer of the mixture around a conductor 16 as it is fed upwardly through the die. The mixture thus provides a supporting fluid force means for the die means as it holds the die means in a certain vertical position. As shown by the figure, the die is of frustoconical shape, tapering towards its upper end, and having a lower annular edge 18 formed between inner and outer converging frustoconical surfaces 20 and 22. The die is supported upon a flotation collar 24 with an upstanding cylindrical wall 26 and a lower horizontal flange 28, the edge 18 carried in a corner formed between the flange and the wall 26. As shown, the wall 26 projects above the upper surface 30 of the mixture and this prevents the mixture from flowing inside the wall and from contacting the outer surface 22 of the die to maintain the floating relationship of the die within the mixture. As shown by FIG. 1, the die orifice 15 projects above the surface 30 of the mixture.

The die orifice material must be sufficiently hard to prevent erosion by contact with the ferrite material. Such a material is a ceramic material, e.g. Henium, manufactured by Heny Die Corporation. Other suitable materials include a diamond die insert.

Disposed above the container 10 is a vertical drying oven 34 for drying the coating of material upon the conductor immediately after it has passed through the die orifice 15. Immersed in the mixture 12 and beneath the die are guide pulleys 36 for guiding the conductor 16 from a reel 38 which is located outside the container.

In use of the apparatus, the conductor 16 is fed from the reel 38 downwardly around the guide pulleys 36 and upwardly through the mixture and out through the orifice 15. Basically, the mixture becomes entrained around the conductor as it passes upwardly and through the orifice to form a coating of insulating material 40 upon the conductor and this coating is then dried in the drying over 34 to cure the latex material and to form an insulation 42 upon the conductor, which insulation is a continuously loaded layer in that it is formed from the cured latex emulsion within which are dispersed the ferrite particles.

In greater detail, during the formation of the coating 40, the apparatus operates to ensure that the coating is formed concentrically with the conductor even though the conductor may wander slightly laterally of its intended path as it moves upwardly from the guide pulleys 36 through the drying oven and to a further guide pulley (not shown) disposed a substantial distance above the pulleys 36. Hence, with such a large distance between the pulleys, it is understandable that the conductor may wander uncontrollably sideways during its upwards movement. However, although such a wandering movement may take place, this will have an effect upon the concentricity of the coating 40 upon the conductor. As the conductor moves in any direction laterally of its path, it is found that this movement is followed closely by a corresponding movement of the floating die upon the mixture. This movement is controlled and ensured by the hydrodynamic forces which exist between the conductor and the surfaces of the die which are constantly balanced during drawing of the conductor through the die orifice. This is a naturally occurring balance which is not upset by the wandering conductor if, as in this case, the die is also allowed to wander across the mixture 12. Thus the adjustment of the die relative to the fluid to maintain the concentricity is automatic and eccentricity of the coating is substantially negligible with this apparatus.

It has been found that with the use of this apparatus and the method of forming a coating that the coating thickness, while being concentric, may be extremely thin as may be desirable for providing insulating coatings on telecommunications conductors for telecommunications cable cores. In this particular case, it has been found that a thickness of dried insulation 42 of 1.4 mils may be provided with the use of the apparatus of the first embodiment in the case where the fluid is a mixture of latex and ferrite particles as has been described. Even though the finished thickness is so small, the concentricity of the layer around the conductor is maintained during application by the use of the apparatus described. Hence no significant eccentricity of the layer has been found to occur and which could have any effect upon the electrical characteristics of a finished cable or could produce any deleterious results during further processing, e.g. during the addition of a further layer. Thus, the first embodiment provides a method of providing an insulating layer upon a conductor and while this layer may be extremely thin, concentricity results from the method. Of course, with the conductor disposed vertically, the coating material which is of an extremely low viscosity, cannot flow laterally around the conductor as in a horizontally disposed condition, so that any concentricity which is obtained by the die 15 is maintained as the conductor proceeds through the drying oven.

A further advantage with the use of this apparatus and method is the fact that while extremely thin coatings are provided upon conductors, there is no tendency for the mixture to dry in the region of the die orifice and thus any distortion of the die orifice shape by dried material will not result. Thus dried material cannot have any effect upon the concentricity of the finished insulating layer.

The mixture is prevented from drying in various ways. Firstly, while care is taken to ensure that the mixture is substantially viscous to enable the conductor to be pulled through the aperture without creating any upward forces such as to draw the die upwardly out of the mixture, the fluid temperature should not be such as to assist in the drying action. In this present case, it has been found that a viscosity of 5,000 centipoise is sufficient to prevent the lifting of the die out of the mixture at a line speed of the conductor of up to 200 ft. per minute. By using the latex which has been described, it has been found that a suitable viscosity is obtained if the latex is maintained at an ambient room temperature which may be around 15° C. In the event that it is necessary to control the temperature of the latex to hold its viscosity to that required, then the container 10 may be provided with heating or cooling devices (not shown) such as passageways for a heating or cooling fluid which is supplied from some source. Of course, if other suitable carriers were to be used, then different temperature requirements could become apparent. Secondly, to prevent the drying action, steps are taken to ensure that the ambient air does not reach the regions of the die immediately upstream along the feedpath from the die orifice 15. As shown with the present construction, the die 14 is of solid unapertured form apart from at the die orifice. It has been found with the use of the inner frustoconical surface 20 then, as the conductor moves upwardly towards the die, its speed and drag effect tends to draw the mixture 12 within the die upwardly above the surface 30 so that a head of the mixture within the die is maintained up to the orifice 15 itself as shown in FIG. 1. Hence the orifice overcomes the drag effect to control the thickness of the coating 42 as the conductor emerges. The result of this is, of course, that the mixture completely occupies the whole of the space surrounded by the surface 20 whereby air is not present within this region to assist in drying of the mixture 12.

As shown by the above embodiment, the invention satisfactorily overcomes any problem with the provision of a continuously loaded layer or of an ordinary non-loaded insulating layer upon a conductor where it is necessary to apply the fluid material to form the layer in a low viscous form. Concentricity of the final layer is ensured although the thickness of the layer may be reduced to a minimum as exemplified by the above embodiment.

Figure 2:
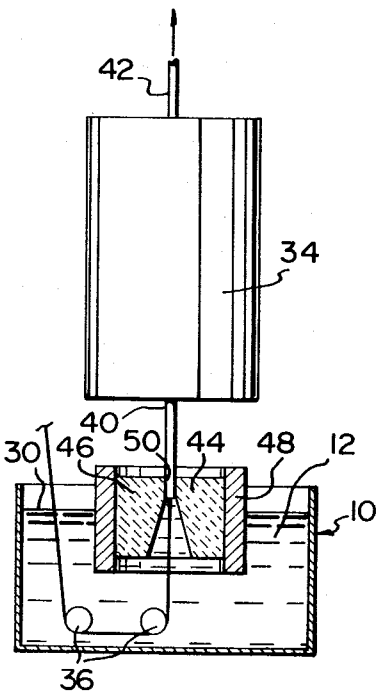
FIG. 2 is a cross-sectional view of part of an apparatus according to a second embodiment.

In a second embodiment, as shown in FIG. 2, the die is different from that described in the first embodiment. As shown by FIG. 2, the die is a solid ceramic die 44 which may be Henium. This die differs from the die 14 in that its outer frustoconical surface is replaced with a flat horizontal surface 46. This change in shape will have no effect upon the operation of the die. In addition, a flotation collar 48 is of slightly different construction from the collar 24 in that the lower flange 28 described in the first embodiment is omitted. In use of the die in the apparatus of the second embodiment, flotation is maintained by the buoyancy effect of the mixture 12 upon the lower ends of the flotation collar 48 and of the die 44 and the design is such to ensure that the displacement of the mixture by the die still maintains the downstream end of the die orifice 50 in a position away from surrounding contact with the fluid 12. In this case, as in the first embodiment, this is ensured by the flotation collar 48 extending upwardly beyond the surface 30 of the mixture 12.

Figure 3:
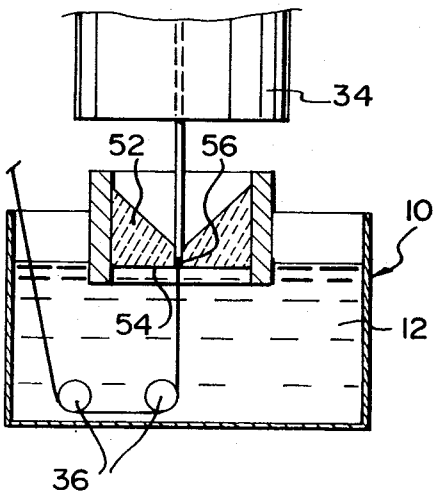
FIG. 3 is a view similar to FIG. 1 of a modification of the second embodiment.

It is not an essential requirement that the die has a frustoconical inner surface such as shown in the first and second embodiments. For instance, as shown by FIG. 3, which is a modification of the second embodiment, the die 52 represented therein is an inversion of the die 44 in the second embodiment and has a lower planar surface 54 which confronts the mixture 12 in the container 10. The die orifice is maintained in such a position that the level of the mixture will not submerge the orifice completely. In this particular case, the die orifice 56 has an upper end disposed above the level 30 of the mixture 12.

In a third embodiment as shown in FIGS. 4, 5, 6 and 7, apparatus for providing an insulating layer upon an electrical conductor 60 comprises a container 62 holding a quantity of a coating fluid 64. This coating fluid may be a mixture of a fluid carrier and magnetically permeable particles as described in previous embodiments, or it may be formed solely from polymeric material in molten state.

A die means 66 comprises an inverted frustoconical member 68 formed with an extrusion orifice 70 at an upper end of a central passageway 72. An outer frustoconical surface 74 of the member 68 thus extends upwardly and is inclined outwardly from the die orifice. The frustoconical member 68 is housed within a surrounding die support means in the form of a die holder 76 which is upstanding from a horizontal support 78, which extends completely across the container and is sealed to the container sides. The die holder 76 has a frustoconical inner surface 80 which is complementary to and confronts the surface 74 of the member 68. When not in use, the member 68 is supported by the die holder by the surfaces 74 and 80 engaging one another.

Defined below the support 78 is an air pressure chamber 82. This is defined by an annular wall 84 extending downwardly from the support and a bottom wall 86. A central aperture 88 is provided within the wall 86. Through the aperture passes a tubular extension 90 of the frustoconical member 68, the extension 90 passing below the surface of the fluid 64. As will be seen, the extension 90 forms a baffle to prevent the fluid 64 passing upwardly towards the orifice 70 from being affected by pressurized air within the chamber 82. Air under pressure is supplied through an inlet 92 to the chamber and this air is expelled through a series of orifices 94 in the support 78, these orifices being around an arc and aligned with the interfacial area between the surfaces 74 and 80, the orifices forming means to enable pressurized gas to be passed between the surfaces. When pressurized air passes through the orifices 94, then the pressure is sufficient to provide a supporting fluid force under the influence of the die means to raise the member 68 slightly away from the die holder thereby separating the surfaces 74 and 80 and providing a passage means for the flow of the air.

Figure 6:
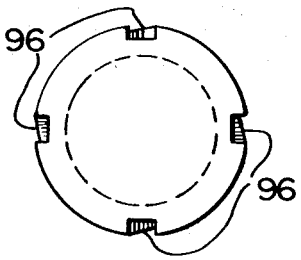
FIG. 6 is a view of the die means in the direction of arrow 'VI' in FIG. 5.
Figure 5:
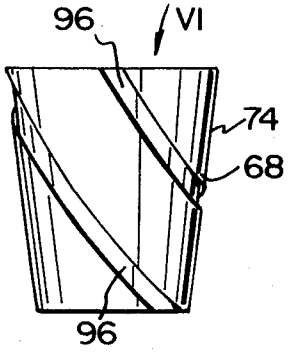
FIG. 5 is a side elevational view of die means of the third embodiment and on a larger scale than FIG. 4.
Figure 4:
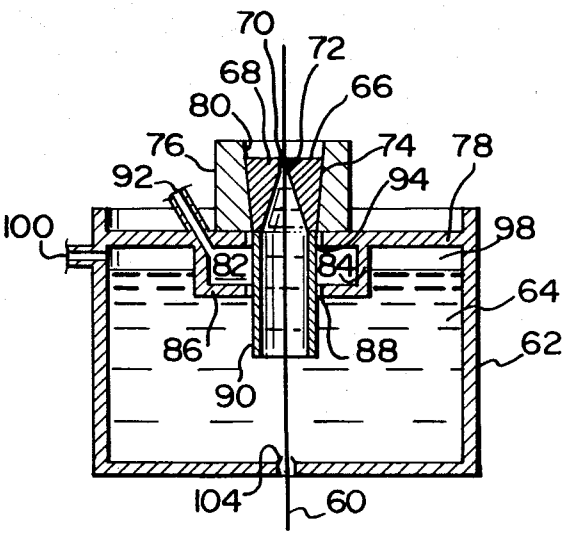
FIG. 4 is a view similar to FIG. 1 of a third embodiment.

Means are provided for effecting rotation of the member 68 in use. This means comprises a plurality of channels 96 which are formed in the surface 74 and extend upwardly as shown in FIGS. 5 and 6, while at the same time extending around the member 68, i.e. at an angle to the longitudinal axes of the die member 68.

A space beneath the support 78, lying above the fluid 64 and surrounding the wall 84 is also connected to a source of pressurized air. This space 98 is served with air through an inlet 100 which extends through a wall of the container 62. With a balance of the air pressures supplied through the inlets 92 and 100, it is ensured that the fluid 64 will not be forced upwardly through any gap between the tubular extension 90 and the sides of the central orifice 88 and in the chamber 82. Alternatively, the pressure in the chamber 98 also prevents the pressurized air in the chamber 82 from escaping downwardly through the gap instead of passing through the orifices 94.

Figure 7:
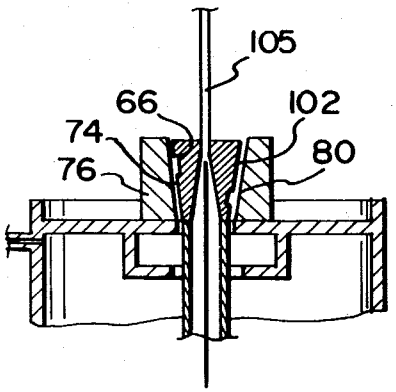
FIG. 7 is a view similar to FIG. 4 of the apparatus of the third embodiment in use.

In use of the apparatus of the third embodiment, and with the air pressures applied to the chambers 82 and 98 as described, the member 68 is raised by the pressure passing through the apertures 94 so that a slight frustoconical clearance 102 is developed between the surfaces 74 and 80 as shown by FIG. 7. The pressurized air thus acts as a supporting fluid force for the die means and the surfaces 74 and 80 comprise a means for providing a supporting fluid force by defining the passage for the pressurized air. Also with the air passing through the channels 94, the member 68 is caused to rotate in its levitated condition.

The conductor 60 to be coated is passed upwardly through a sealed orifice 104 in the bottom of the container 62. The conductor passes vertically upwards through the tubular extension 90 and out through the aperture 70 and draws fluid 64 through the tubular extension and to the orifice where a wiping operation takes place to provide the conductor with the desired thickness of coating material 105. As described in the first embodiment, the coating fluid is of low viscosity, such as not to raise the member 68 as the conductor passes through the orifice with the result that an extremely thin layer of material may be placed upon the conductor by the die. As the conductor proceeds upwardly and becomes coated, the rotation of the die member 68 effects a rotational wiping of the fluid 64 onto the conductor as it passes through the rotating die orifice. This rotation assists in providing an evenly distributed layer upon the conductor. In a case where the fluid 64 is a mixture containing magnetically permeable particles, then there is a tendency to orientate the particles in a circumferential direction of the conductor with possibly a slight helical component to their direction. This orientation of the particles provides a degree of control upon the manner in which particles are located in position within the layer. Hence, there is a tendency towards constancy in the orientation of the particles along the conductor length which assists in enhancing constancy in electrical characteristics.

Furthermore, because of the slight clearance which is developed between the surfaces 74 and 80 to provide the passage means 102, then some lateral movement of the member 68 is allowable to enable the member to follow lateral movement of the conductor should it tend to wander from its true vertical path. Such movement is accomplished by the hydrodynamic forces in the fluid 64 as described in the first embodiment. Of course such a lateral movement of the member 68 assists in providing concentricity of the layer around the conductor 60.

In further embodiments now to be described, the supporting fluid force is neither a liquid nor a fluid in the sense of being a pressurized gas. Instead the supporting fluid force is a magnetic flux and the means for providing this force comprises at least one magnet as will be described.

Figure 8:
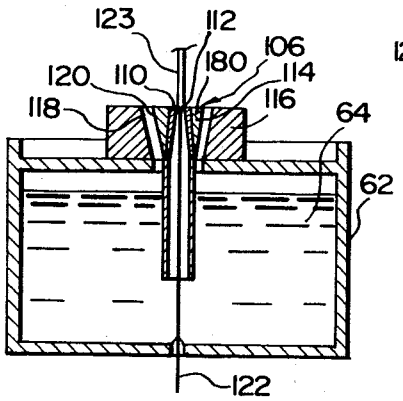

In a fourth embodiment as shown by FIG. 8 in which features similar to that described in the third embodiment are given the same reference numerals, a die means 106 comprises an inverted frustoconical die member 108 comprising a central die member 110 formed with an orifice 112. The member 110 is surrounded by an annular magnet 114 having radially spaced poles. A die means 116 is in the form of an annular magnet also having radially spaced poles. An inner frustoconical surface 118 of the holder 116 is complementary in shape to the frustoconical surface 120 of the die means. The relationship of the poles is such that the poles at the surfaces 118 and 120 of the die means and the holder are mutually repelling poles, i.e., both poles are either south poles or north poles.

In use, the die means 108 is held in a levitated position by the magnetic flux created between the two magnets whereby the surfaces 118 and 120 are out of contact. A conductor 122 is passed upwardly through the fluid 64 and out through the die aperture 112 at which the coating layer 123 is wiped onto the conductor as described in previous embodiments. As indicated, this embodiment is of particular use for a coating fluid having magnetically permeable particles in admixture with a carrier. As this mixture passes upwardly through the tubular extension 90 and out through the orifice 112, the magnetic flux which is created tends to orientate particles in a radial direction of the layer. As a specific orientation is provided, then this gives uniformity to the structure after drying in the oven disposed above the container, thus enhancing constancy in electric characteristics.

Also, because of the levitated position of the die means 108, some lateral movement of the die means is possible under the hydrodynamic forces in the fluid in the event that the conductor wanders laterally from its chosen vertical path. As with the third embodiment, therefore, such lateral movement of the die means assists in maintaining the coating concentrically disposed upon the conductor.

The magnetic field strength should be such as to hold the die means levitated without providing sufficient additional upward force to assist the viscous mixture to cause raising of the die means away from the die holder.

In the above embodiment while the two magnets described are permanent magnets, in the modification a similar magnetic flux effect is obtainable in the case where the outer magnet, i.e. the die holder, is a DC excited electromagnet. In this case the current provided to the die holder may be varied to produce different heights of levitation of the die means, thereby altering the degree of lateral movement of the die member and also to compensate for any changes in drag within the die by the coating fluid.

It is possible to provide a continous loaded layer upon a conductor in which the magnetically permeable particles are orientated in yet another direction, i.e. longitudinally of the conductor.

Figure 9:
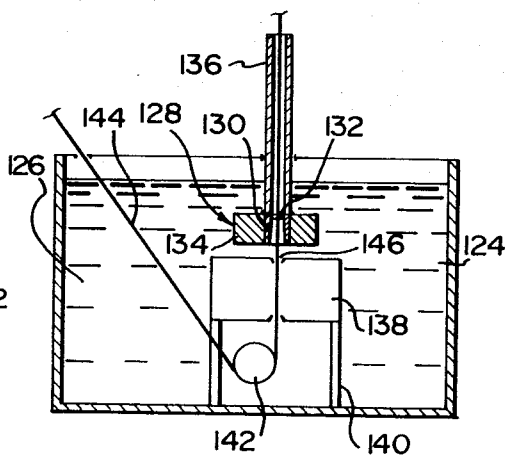

This is exemplified in a fifth embodiment, in apparatus for coating a conductor as shown by FIG. 9. In this embodiment, a container 124 holds a quantity of coating fluid which is a mixture 126 of fluid carrier and magnetically permeable particles as described in previous embodiments. A die means 128 comrises a die 130 defining an orifice 132 and the die is surrounded by an annular magnet 134 having opposite poles disposed in the direction of flow of the mixture through the orifice, longitudinally of the conductor path. It is proposed that the magnet and die member are submerged within the mixture 126 in use and for preventing the mixture from contacting the downstream side of the extrusion orifice, a protective tubing 136 of no magnetic material is sealed to the upper side of the die and extends upwardly above the level of the mixture.

Below the die means and the magnet is disposed a horizontal baffle 138 carried upon supporting legs 140 within the fluid. Beneath the baffle is located a guide pulley 142 for guiding conductor 144 directly upwardly through the orifice 132. The baffle 138 is provided with a passage 146 for the conductor.

In use of the fifth embodiment, the magnet is levitated within the mixture 126 because of the strength of the magnetic flux which holds it at a position above the support 138 dictated by the strength of the field. The particles surrounding the magnet and the die in the mixture become orientated along the lines of force. Also as the mixture passes upwardly through the die and through the die orifice, the particles are orientated along the flux lines, i.e. extending from the north to the south poles, which is in the longitudinal direction of the conductor. Hence, the coating provided upon the conductor has particles which are orientated in the longitudinal or axial direction of the conductor and these particles are held in this state after drawing.

Figure 10:
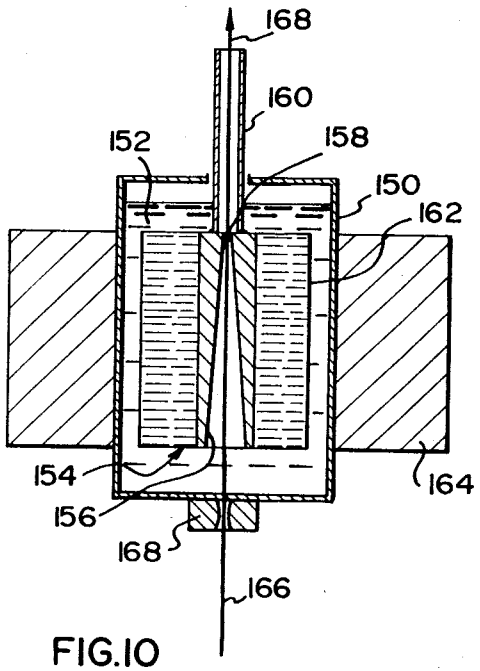
FIGS. 8, 9 and 10 are views similar to FIG. 1, respectively, of apparatus according to fourth, fifth and sixth embodiments.

In a sixth embodiment as shown by FIG. 10, a container 150 holds a quantity of fluid which is a mixture 152 of carrier and magnetically permeable particles as described above. Within the mixture is a freely contained die means 154. This die means comprises a die member 156 with die orifice 158 and a protective tubular extension 160 which extends upwardly from the mixture and out from the container. The die means also includes a circumferentially segmented rotor 162 which surrounds and is secured to the die. The segments of the rotor are electrically isolated from each other and are formed from soft iron bars or are individually wound.

A supporting fluid force means of the apparatus comprises a means to provide a rotating magnetic field around the container. This means is in the form of a three-phase field winding 164 which is in annular configuration around the container.

In use of the apparatus of the sixth embodiment, the rotor and thus the die is held in a specific position levitated within the fluid 152 by the magnetic flux created by the three-phase field winding 164 and influenced by the quantity and permeability of the particles in the mixture. In addition, the rotor 162 and the windings 164 act together as a low horse power AC motor whereby the rotor and die rotate because of the rotating magnetic field. A conductor 166 fed through an entrance seal 168 in the bottom of the container is fed upwardly through the die orifice. The coating layer 168 provided has its particles formed with a circumferential component of orientation, which also tends to have an axial component.

What is claimed is:

1. A method of providing an insulated electrical conductor by passing the conductor upwardly through a coating fluid and then upwardly through a die means, which is held in a vertical position relative to the fluid by a supporting fluid force which holds the die means horizontally spaced from a surrounding annular die support means while upwardly supporting the die means, with the support means causing or influencing the fluid force, thus allowing the die means freedom to move horizontally, the die means controlling the thickness of a surrounding layer of the fluid upon the conductor, the viscosity of the fluid being insufficient to raise the die means away from the fluid as the fluid coated conductor passes through the die, and concentricity of the fluid coated onto the conductor being ensured during any lateral movement of the conductor, by corresponding horizontal movement of the die means caused by hydrodynamic forces existing between the conductor and die surfaces.

2. A method according to claim 1, wherein the conductor in passing through the die means towards the die orifice passes through a region defined by a surface of the die means which converges towards the die orifice and the coating fluid is drawn by the moving conductor into said region to prevent air from contacting the fluid in a position upstream from the die orifice.

3. A method according to claim 1, wherein the fluid coated conductor is passed vertically upwards from the die orifice through a vertical drying oven to dry the fluid and form it into a layer of insulation on the conductor.

4. A method according to claim 1, comprising coating the conductor with the fluid in the form of a mixture of a fluid carrier and magnetically permeable particles and after passage through the die orifice, the coated conductor is passed through a vertical drying oven to dry the fluid into a continuous loaded layer upon the conductor.

5. A method according to claim 1 comprising providing the die means and the die support with confronting frustoconical surfaces and passing pressurized gas between said surfaces to form passage means by raising the die means upwardly and spacing it horizontally from the die support.

6. A method according to claim 5, comprising causing the die means to rotate around the die orifice by passing the pressurized gas at an angle around the die means through the passage means, which extend around and upwardly of the die means.

7. A method according to claim 1, comprising providing at least part of the die means as a first magnet and disposing the first magnet within a second and annular magnet provided by the die support means, with the two magnets each having radially related poles and mutually repelling poles opposed to each other at confronting surfaces of the magnets to cause the magnetic flux to provide the supporting fluid force.

8. A method according to claim 7 comprising providing the coating fluid as a fluid carrier in admixture with magnetically permeable particles and orientating said particles in the radial direction of the conductor by the influence of the magnetic flux as the coated conductor passes through the die.

9. Apparatus for insulating an electrical conductor including a container for holding a quantity of a coating fluid, die means having a die orifice and an annular die support means which surrounds the die means radially of the die orifice, the die support means provided to cause or influence a supporting fluid force to support the die means vertically upwards while holding the die means horizontally spaced from and within the support means.

10. Apparatus according to claim 9, wherein regions of the die means directly upstream from the die orifice and forming an entrance thereto, are completely sealed from ambient atmosphere to prevent drying of the coating fluid in these regions or at the die orifice itself.

11. Apparatus according to claim 9, wherein the regions directly upstream from the die orifice are defined by a frustoconical surface which tapers towards the die orifice.

12. Apparatus according to claim 9 wherein the die means and die support means have confronting frustoconical surfaces, each surface increasing in diameter in an upward direction, and means is provided for connection to pressurized gas means to enable pressurized gas to be passed between the surfaces to raise the die means and support it vertically away from the die support means.

13. Apparatus according to claim 12, wherein frustoconical surface of the die means is formed with channels which extend upwardly and around the die means to effect rotation of the die means when gas flows through the channels.

14. Apparatus according to claim 12, wherein the container comprises at least one guide pulley within the mixture to direct the conductor vertically upwards and through the die orifice, and a horizontal baffle above the guide pulley and with a passage for conductor to the die orifice, the die means levitated by the magnet to a specific position above the baffle.

15. Apparatus according to claim 9, wherein the die support means comprises a means for providing a rotating magnetic flux around the container, and the die means comprises a circumferentially segmented rotor, the segments being electrically isolated from each other and the means for providing the flux acting with the rotor as an AC motor to effect rotation of the die means including the rotor, whereby when the coating fluid includes magnetically permeable particles, the die means is levitated to its position by the strength of the magnetic flux and the quantity and permeability of the particles.

16. Apparatus according to claim 9, wherein the die means comprises a permanent magnet and the die support means comprises an annular magnet surrounding the die means, the two magnets having confronting frustoconical surfaces each of which increases in diameter in an upward direction and poles of the magnets at the confronting surfaces are similar whereby the magnetic flux provides a supporting fluid force to cause the die means to be repelled upwardly by the other magnet.

17. A method of providing an insulated electrical conductor by passing the conductor upwardly through a coating fluid and then upwardly through a die means, the fluid comprising a fluid carrier in admixture with magnetically permeable particles, disposing the die means within the carrier with the die means having freedom to move horizontally and including a magnet with its poles disposed in the direction of fluid flow through the die orifice, and levitating the magnet to a position within the mixture dictated by the strength of the magnetic flux of the magnet.

18. Apparatus for insulating an electrical conductor including a container for holding a quantity of a coating fluid comprising a mixture of a fluid carrier and magnetically permeable particles, and die means having a die orifice and a magnet with poles relatively disposed in the direction of fluid flow through the die orifice, the magnet when immersed within the mixture being levitated by the strength of the magnetic flux and the quantity and permeability of the particles to locate the die means in a specific position within the container.

* * * * *